US007191531B1

(12) United States Patent
Mitchell

(10) Patent No.: US 7,191,531 B1
(45) Date of Patent: Mar. 20, 2007

(54) CORNER MARKING DEVICE

(76) Inventor: Frank R. Mitchell, 7658 S. Jackson Rd., Saranac, MI (US) 48881

( * ) Notice: Subject to any disclaimer, the term of this patent is extended or adjusted under 35 U.S.C. 154(b) by 229 days.

(21) Appl. No.: 10/905,837

(22) Filed: Jan. 22, 2005

(51) Int. Cl.
*B43L 13/02* (2006.01)

(52) U.S. Cl. ..... 33/36; 33/41.4; 33/32.2; 33/669

(58) Field of Classification Search ..... 33/36, 33/32.2, 32.1, 34, 35, 37, 41.1, 41.3, 41.4, 33/41.6, 42, 43, 44, 414, 669, 679
See application file for complete search history.

(56) References Cited

U.S. PATENT DOCUMENTS 997,803 A 7/1911 Giffin
2,305,095 A * 12/1942 Corkish ..... 33/42
2,451,595 A * 10/1948 Wheeler ..... 33/36
2,529,210 A * 11/1950 Butler ..... 33/44
2,829,436 A * 4/1958 Leinwebber ..... 33/42
3,721,009 A 3/1973 Lucich
3,903,608 A * 9/1975 Garrison et al. ..... 33/407
4,372,049 A * 2/1983 Hogue ..... 33/36
4,660,291 A 4/1987 Dehn
5,063,681 A 11/1991 Bradley
5,940,979 A * 8/1999 Ericksen et al. ..... 33/667
6,167,632 B1 1/2001 Shor
6,470,581 B1 10/2002 Kolodzieski

* cited by examiner

*Primary Examiner*—Christopher W. Fulton
(74) *Attorney, Agent, or Firm*—Donald R. Schoonover

(57) ABSTRACT

A device that can be used to place lines on structures adjacent to a corner. The device includes an L-shaped body that has two sections that intersect each other at a right angle. A chalk-depositing roller is rotatably and movably mounted on each section and deposits chalk on a surface as the device is moved. The corner of a building is accommodated adjacent to the right angle of the L-shaped body.

2 Claims, 1 Drawing Sheet

CORNER MARKING DEVICE

BACKGROUND OF THE INVENTION

The present invention relates to the general art of geometric devices, and to the particular field of marking devices.

When constructing a structure, there is often a need to define a guide line adjacent to a corner of the structure. Placing siding on a building is one example of a situation which may require lines to be placed on a structure.

One problem encountered by many craftsmen is associated with skewed or crooked corners on a structure. Such skew may arise because the building has settled, or because of errors in initial construction. Whatever the cause, such skew may create a problem in properly placing siding.

Therefore, there is a need for a means for placing marks on a structure adjacent to a corner of that structure which can automatically account for skewed or crooked corners.

Any tool that is intended to save work must, of course, work efficiently and be easy and expeditious to use. Otherwise, its purpose is defeated.

Therefore, there is a need for a means for placing marks on a structure adjacent to a corner of that structure which can automatically account for skewed or crooked corners yet which is easy and expeditious to use.

Since marks must often be placed on walls adjacent to either an inside or an outside corner, any device that is intended to place marks on walls adjacent to corners must be amenable for use on either an inside corner or an outside corner without requiring major changes in the device.

Therefore, there is a need for a means for placing marks on a structure adjacent to a corner of that structure which can automatically account for skewed or crooked corners and which is easily adaptable for use on either an inside corner or on an outside corner.

Any tool that is intended to replace other tools should be usable in a manner that is close to the manner in which the replaced tool was used. This will make it easy for a workman to adapt to the new tool and make the new tool more desirable.

Therefore, there is a need for a means for placing marks on a structure adjacent to a corner of that structure which can automatically account for skewed or crooked corners and which does not require a significant change in the operation of placing such marks on the structure as compared to existing marking tools.

PRINCIPAL OBJECTS OF THE INVENTION

It is a main object of the present invention to provide a means for placing marks on a structure adjacent to a corner of that structure which can automatically account for skewed or crooked corners.

It is another object of the present invention to provide a means for placing marks on a structure adjacent to a corner of that structure which can automatically account for skewed or crooked corners yet which is easy and expeditious to use.

It is another object of the present invention to provide a means for placing marks on a structure adjacent to a corner of that structure which can automatically account for skewed or crooked corners and which is easily adaptable for use on either an inside corner or on an outside corner.

It is another object of the present invention to provide a means for placing marks on a structure adjacent to a corner of that structure which can automatically account for skewed or crooked corners and which does not require a significant change in the operation of placing such marks on the structure as compared to existing marking tools.

SUMMARY OF THE INVENTION

These, and other, objects are achieved by a marking device which comprises an L-shaped body having a first leg and a second leg, the first leg being oriented at a right angle with respect to the second leg, each leg having a first surface and a second surface; a chalk dispensing unit in each leg of the body; a chalk roller rotatably and movably mounted on each leg of the body adjacent to the chalk dispenser unit in each leg, each of the chalk rollers being sized to extend beyond a plane containing the first surface of each leg and beyond a plane containing the second surface of each leg; and a mechanism mounted on the body and operably connected to each of the chalk rollers to move the chalk rollers toward and away from each other when operated.

Using the marking device embodying the present invention will permit a workman to quickly, easily, and accurately place marking lines on a building adjacent to a corner of a building. The marking device embodying the present invention automatically accounts for any skew or inaccuracy of the building corner so the lines placed on the building are accurate with respect to the corner. The device places a chalk line on the building so the workman will be using a line that he is used to using whereby there are no significant changes in the way he must work in order to use the device embodying the present invention. The device can be used to place marks on either the inside or on the outside of a building without any significant change in the manner in which the device operates. Accordingly, the device is very versatile and easy to use.

BRIEF DESCRIPTION OF THE DRAWING FIGURES

DETAILED DESCRIPTION OF THE PREFERRED EMBODIMENT

Figure 2:
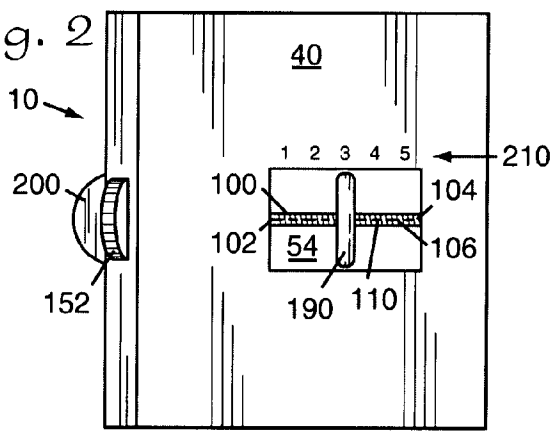
FIG. 2 is an elevational view of the corner marking device shown in FIG. 1.

Other objects, features and advantages of the invention will become apparent from a consideration of the following detailed description and the accompanying drawings.

Referring to the Figures, it can be understood that the present invention is embodied in a corner marking device 10 that achieves the above-stated objectives.

Corner marking device 10 comprises an L-shaped body 14 which can be formed of any suitable material and will be used on either the inside of a building or on the outside of a building to define guide lines or the like.

Body 14 includes a first section 20 which has a first end 22 which is a top end when body 14 is in use, a second end 24 which is a bottom end when body 14 is in use, and a longitudinal axis 26 which extends between first end 22 and second end 24. First section 24 further includes a first side 30, a second side 32, and a width dimension 34 that extends between first side 30 and second side 32.

A first surface 40 is an outside surface when body 14 is in use, and a second surface 42 is an inside surface when body 14 is in use. In use, first surface 40 will slidingly abut the inside surface of a wall when device 10 is used to mark the inside surfaces of the wall; whereas, second surface 42 will slidingly abut the outside surface of a wall when device 10 is used to mark the outside surfaces of the wall.

A thickness dimension 46 extends between first surface 40 and second surface 42 of first section 20.

A cutout section 50 is defined in first surface 40 and a cutout section 52 is defined in second surface 42. Cutout section 52 is congruent with cutout section 50 to define an opening 54 in first section 20 that extends between the first and second surfaces 40, 42 of first section 20.

Body 14 further includes a second section 60 which is similar to first section 20 and which has a first end 62 which is a top end when body 14 is in use, a second end 64 which is a bottom end when body 14 is in use, and a longitudinal axis 66 which extends between first end 62 and second end 64.

Second section 60 further includes a first side 70, a second side 72, and a width dimension 74 that extends between first side 70 and second side 72.

A first surface 80 is an outside surface when body 14 is in use. First surface 80 intersects first surface 40 of first section 20 to define an outer corner 82 of body 14.

Figure 1:
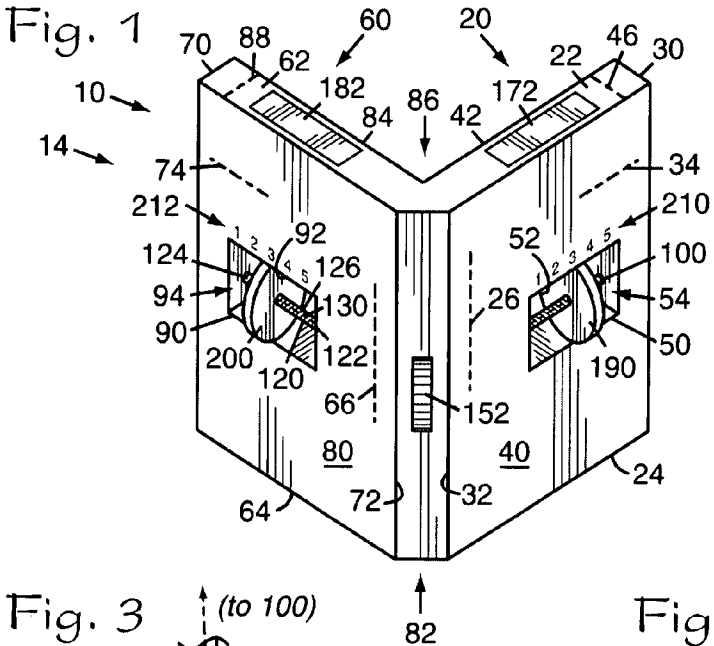
FIG. 1 is a perspective view of a corner marking device embodying the present invention.
Figure 3:
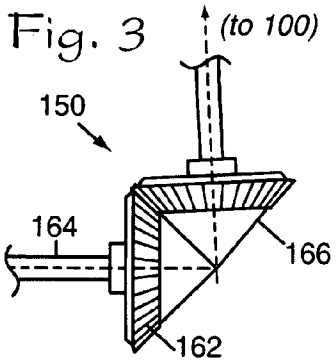
FIG. 3 is a top plan view of the corner marking device of the present invention.

A second surface 84 is an inside surface when body 14 is in use. Second surface 84 intersects second surface 42 of first section 20 to define an inner corner 86 of body 14. Inner corner 86 can be a right angle as indicated in FIG. 1 or a polygon as indicated in FIG. 3, whichever is most suitable for accommodating a corner of a building as well as accommodating the elements of device 10 as will be understood from the following disclosure.

A thickness dimension 88 extends between first surface 80 and second surface 84 of second section 60.

A cutout section 90 is defined in first surface 80 and a cutout section 92 is defined in second surface 84. Cutout section 92 is congruent with cutout section 90 to define an opening 94 in second section 60 that extends between the first and second surfaces 80, 84 of the second section 60.

A first axle 100 is rotatably mounted on first section 20 to span opening 54 defined in the first section 20. First axle 100 includes a proximal end 102 and a distal end 104, and has an external screw thread 106 defined thereon adjacent to proximal end 102. Proximal end 102 is located closer to inner corner 86 than distal end 104. First axle 100 has a longitudinal axis 110 which extends between distal end 104 and proximal end 102. First axle 100 is mounted on first section 20 to be rotatable about longitudinal axis 110 and to be moveable in the direction of longitudinal axis 110.

A second axle 120 is rotatably mounted on second section 60 to span opening 94 defined in the second section 60. Second axle 120 includes a proximal end 122 and a distal end 124, and has an external screw thread 126 defined thereon adjacent to proximal end 122. Proximal end 122 of second axle 120 is located closer to inner corner 86 of body 14 than distal end 124. Second axle 120 has a longitudinal axis 130 which extends between distal end 124 and proximal end 122. Second axle 120 is mounted on second section 60 to be rotatable about longitudinal axis 130 and to be moveable in the direction of longitudinal axis 130.

Figure 4:
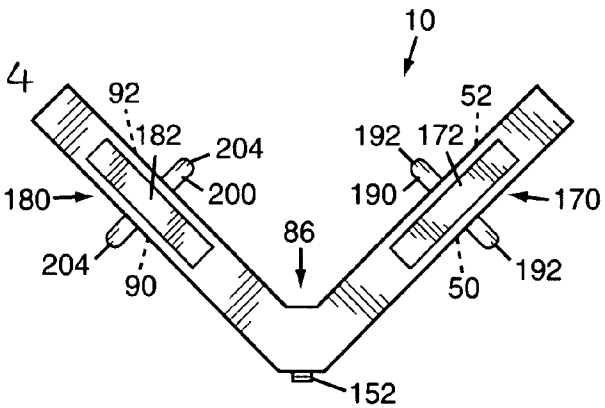
FIG. 4 shows plain bevel gears with a shaft at an obtuse angle that can be used in the corner marking device of the present invention.

A mechanism 150 is mounted on body 14 and is operably connected to the first and second axles 100, 120 to rotate those axles and to move those axles in the directions of the longitudinal axes 110, 130 of those axles during such rotation. Mechanism 150 includes a thumb knob 152 which is operably connected to a suitable mechanism, such as plain bevel gears with a shaft oriented at an obtuse angle as shown in FIG. 4. While other mechanisms can be used as will occur to those skilled in the art, it is noted that FIG. 4 shows only two bevel gears for the purposes of simplicity of drawing. However, a third bevel gear will be included in mechanism 150 so that a central gear, such as gear 162 which is connected to thumb knob 152 by a shaft 164, will operate two bevel gears, including bevel gear 166, which is connected to first axle 100, and an identical bevel gear which is also meshed with first bevel gear 162 and which is connected to second axle 120. Other mechanisms can be used without departing from the scope of the present disclosure such as will occur to those skilled in the art based on the teaching of this disclosure. The exact details and form of the operating mechanism 150 is not important to this invention and thus the exact details of the mechanism 150 will not be presented.

A first chalk dispensing unit 170 is mounted on first section 20 adjacent to opening 54 defined in the first section 20. First chalk dispensing unit 170 has an access door 172 defined in first end 22 of the first section of body 14.

A second chalk dispensing unit 180 is mounted on second section 60 adjacent to opening 94 defined in second section 60. Second chalk dispensing unit 180 has an access door 182 defined in first end 62 of second section 60.

A first marking wheel 190 is rotatably mounted on first axle 100 to rotate about longitudinal axis 110 of the first axle 100. First marking wheel 190 is located adjacent to first chalk dispensing unit 170 with first marking wheel 190 having an outer periphery 192 that is at least partially located outside of a plane containing first surface 40 of first section 20 and outside of a plane containing second surface 42 of first section 20.

A second marking wheel 200 is rotatably mounted on second axle 120 to rotate about longitudinal axis 126 of the second axle 120. Second marking wheel 200 is located adjacent to second chalk dispensing unit 180. Second marking wheel 200 has an outer periphery 204 that is at least partially located outside of a plane containing first surface 80 of second section 60 and outside of a plane containing second surface 84 of second section 60. The first and second marking wheels 190, 200 move toward and away from each other when mechanism 150 is operated for a purpose that will be understood from the teaching of this disclosure.

The marking wheels 190, 200 are mounted on the axles 100, 120 to free wheel about the respective axle but to move in the direction of the longitudinal axis of the axle so the wheels can be positioned with respect to the corner of the device but will remain in such selected linear position while rotating about the axles as will be understood from the teaching of this disclosure. The exact details of the structure and elements used to achieve this result are not important to the invention and thus only one form of the details will be disclosed, it being understood that those skilled in the art will be able to design other elements and details based on the teaching of this disclosure. Such elements and details are intended to be encompassed by this disclosure as well.

First locating indicia 210 is positioned on first surface 40 of first section 20 adjacent to cutout section 50 defined in first section 20.

Second locating indicia 212 is positioned on first surface 80 of second section 60 adjacent to cutout section 90 defined in second section 60.

The locating indicia 210, 212 are used to position the marking wheels 190 and 200 with respect to the corner of the body 14 and thus with respect to the corner of the building which is being marked. Using the marking indicia, a worker can precisely and accurately locate a guide line on a building.

Use of device 10 will be understood by those skilled in the art based on the teaching of this disclosure; therefore, such use will not be presented in detail. The marking wheels 190, 200 are located with respect to the corner of the device using mechanism 150, and the device 10 is placed against the building to be marked so that the corner of the building is accommodated in the corner of the device. The device is then moved in the direction of the longitudinal axes 26 and 66 with the marking wheels 190 and 200 rollingly engaging the surface of the building being marked. Chalk is dispensed onto the wheels 190, 200 as they roll and is then transferred by the wheels to the surface of the building being marked. Two straight and accurate lines will be marked on the building. As can be understood, device 10 can be used on either an outside wall or on an inside wall.

It is to be understood that while certain forms of the present invention have been illustrated and described herein, it is not to be limited to the specific forms or arrangements of parts described and shown.

What is claimed is:

1. A marking device comprising:

(a) an L-shaped body having a first leg and a second leg, the first leg being oriented at a right angle with respect to the second leg, each leg having a first surface and a second surface;

(b) a chalk dispensing unit in each leg of said body;

(c) a chalk roller rotatably and movably mounted on each leg of said body adjacent to the chalk dispenser unit in each leg, each of said chalk rollers and being sized to extend beyond a plane containing the first surface of each leg and beyond a plane containing the second surface of each leg; and (d) a mechanism mounted on said body and operably connected to each of said chalk rollers to move said chalk rollers toward and away from each other when operated.

2. A corner marking device comprising:

(a) an L-shaped body which includes (1) a first section having (A) a first end which is a top end when said body is in use, (B) a second end which is a bottom end when said body is in use, (C) a longitudinal axis which extends between the first end of the first section and the second end of the first section, (D) a first side, (E) a second side, (F) a width dimension that extends between the first side of the first section and the second side of the first section, (G) a first surface which is an outside surface when said body is in use, (H) a second surface which is an inside surface when said body is in use, (I) a thickness dimension which extends between the first surface of the first section and the second surface of the first section, (J) a cutout section defined in the first surface, and (K) a cutout section defined in the second surface, the cutout section defined in the second surface of the first section being congruent with the cutout section defined in the first surface of the first section to define an opening in the first section that extends between the first surface of the first section and the second surface of the first section, and (2) a second section having (A) a first end which is a top end when said body is in use, (B) a second end which is a bottom end when said body is in use, (C) a longitudinal axis which extends between the first end of the second section and the second end of the second section, (D) a first side, (E) a second side, (F) a width dimension that extends between the first side of the second section and the second side of the second section, (G) a first surface which is an outside surface when said body is in use, the first surface of the second section intersecting the first surface of the first section to define an outer corner of said body, (H) a second surface which is an inside surface when said body is in use, the second surface of the second section intersecting the second surface of the first section to define an inner corner of said body, (I) a thickness dimension which extends between the first surface of the second section and the second surface of the second section, (J) a cutout section defined in the first surface of the second section, and (K) a cutout section defined in the second surface of the second section, the cutout section defined in the second surface of the second section being congruent with the cutout section defined in the first surface of the second section to define an opening in the second section that extends between the first surface of the second section and the second surface of the second section;

(b) a first axle rotatably mounted on the first section to span the opening defined in the first section, said first axle including a proximal end and a distal end and having an external screw thread defined thereon adjacent to the proximal end of said first axle, the proximal end of said first axle being located closer to the inner corner of said body than the distal end of said first axle, said first axle having a longitudinal axis which extends between the distal end of said first axle and the proximal end of said first axle, said first axle being mounted on the first section to be rotatable about the longitudinal axis of said first axle and to be moveable in the direction of the longitudinal axis of said first axle;

(c) a second axle rotatably mounted on the second section to span the opening defined in the second section, said second axle including a proximal end and a distal end and having an external screw thread defined thereon adjacent to the proximal end of said second axle, the proximal end of said second axle being located closer to the inner corner of said body than the distal end of said second axle, said second axle having a longitudinal axis which extends between the distal end of said second axle and the proximal end of said second axle, said second axle being mounted on the second section to be rotatable about the longitudinal axis of said second axle and to be moveable in the direction of the longitudinal axis of said second axle;

(d) a mechanism mounted on said body and operably connected to said first axle and to said second axle to rotate said first axle and to move said first axle in the direction of the longitudinal axis of said first axle during such rotation and to rotate said second axle and to move said second axle in the direction of the longitudinal axis of said second axle during such rotation;

(e) a first chalk dispensing unit mounted on the first section adjacent to the opening defined in the first section, said first chalk dispensing unit having an access door defined in the first end of the first section of said body;

(f) a second chalk dispensing unit mounted on the second section adjacent to the opening defined in the second section, said second chalk dispensing unit having an access door defined in the first end of the second section of said body;

(g) a first marking wheel rotatably mounted on said first axle to rotate about the longitudinal axis of said first axle, said first marking wheel being located adjacent to said first chalk dispensing unit, said first marking wheel having an outer periphery that is at least partially located outside of a plane containing the first surface of the first section of said body and outside of a plane containing the second surface of the first section of said body;

(h) a second marking wheel rotatably mounted on said second axle to rotate about the longitudinal axis of said second axle, said second marking wheel being located adjacent to said second chalk dispensing unit, said second marking wheel having an outer periphery that is at least partially located outside of a plane containing the first surface of the second section of said body and outside of a plane containing the second surface of the second section of said body, said first and second marking wheels moving toward and away from each other when said mechanism is operated;

(i) first locating indicia positioned on the first surface of the first section of said body adjacent to the cutout section defined in the first section of said body; and (j) second locating indicia positioned on the first surface of the second section of said body adjacent to the cutout section defined in the second section of said body.

* * * * *